United States Patent [19]

Dart

[11] 4,420,081

[45] Dec. 13, 1983

[54] STEP-WALL NESTABLE CUP

[75] Inventor: Kenneth B. Dart, Okemos, Mich.

[73] Assignee: Dart Container Corporation, Mason, Mich.

[21] Appl. No.: 276,016

[22] Filed: Jun. 22, 1981

[51] Int. Cl.[3] ..... B65D 21/02

[52] U.S. Cl. ..... 206/519; 206/520; 220/72; 229/1.5 B

[58] Field of Search ..... 206/519, 520; 220/72; 229/1.5 B

[56] References Cited

U.S. PATENT DOCUMENTS

| | | | |
|---|---|---|---|
| 3,128,029 | 4/1964 | Price et al. . | |
| 3,139,213 | 6/1964 | Edwards . | |
| 3,223,305 | 12/1965 | Edwards . | |
| 3,301,457 | 1/1967 | Millan | 220/266 |
| 3,374,922 | 3/1968 | Shelby . | |
| 3,375,954 | 4/1968 | Honkanen et al. . | |
| 3,437,253 | 4/1969 | Davis et al. . | |
| 3,696,987 | 10/1972 | Schuff et al. . | |
| 3,703,255 | 11/1972 | Wade . | |
| 3,820,684 | 6/1974 | Harrison . | |
| 3,836,063 | 9/1974 | Sutch | 229/1.5 B |
| 4,024,951 | 5/1977 | Green . | |
| 4,082,184 | 4/1978 | Hammer | 206/519 |
| 4,096,947 | 6/1978 | Morse . | |
| 4,111,303 | 9/1978 | Compton . | |
| 4,156,483 | 5/1979 | Day . | |

FOREIGN PATENT DOCUMENTS

| | | | |
|---|---|---|---|
| 2421112 | 11/1979 | France | 220/72 |

*Primary Examiner*—George E. Lowrance

*Attorney, Agent, or Firm*—Miller, Morriss & Pappas

[57] ABSTRACT

A step-wall nestable cup provided with off-set thin sidewall portions which overlap to define an annular intermediate thickened wall portion which strengthens the cup while permitting the use of relatively thinner wall portions thereabove and therebelow. The use of off-set overlapping thin wall sidewall portions also permits the use of a lower density plastic material without increasing the stack height of the nesting cups while resulting in significant material and/or shipping cost savings without sacrificing overall sidewall strength of the resultant nestable cup or container.

A modified step-wall nestable cup is provided with multiple off-set thin sidewall portions which respectively overlap to provide a plurality of annular thickened sidewall portions in the sidewall thereof.

6 Claims, 14 Drawing Figures

STEP-WALL NESTABLE CUP

SUMMARY OF THE INVENTION

This invention relates to a step-wall nestable cup having outwardly off-set thin wall sidewall portions which overlap to define an annular intermediate thickened wall portion which strengthens the cup while permitting the use of relatively thinner wall portions thereabove and therebelow. The use of the off-set overlapping thin wall sidewall portions also permits the use of a lower density plastic material without increasing the stack height of the nesting cups while resulting in significant material savings without sacrificing overall sidewall strength of the resultant nestable cup or container.

A modified version of the invention relates to a nestable cup or container having multiple offset sidewall portions which respectively overlap to provide a plurality of annular thickened wall portions in the sidewall thereof.

This invention further relates to a step-wall nestable cup having a base portion with an integrally formed outwardly inclined sidewall extending upwardly therefrom to terminate at an upper peripheral edge. The sidewall is configured to define a first outwardly inclined thin wall portion extending upwardly from the base portion to overlap with a second outwardly offset similarly inclined upwardly extending thin wall portion. The portion of the sidewall wherein the first thin wall portion overlaps with the second outwardly off-set thin wall portion defines an annular thickened portion in the sidewall which imparts overall strength in the nestable cup while permitting the use of a lower density of material and lower total cup weight. Thus, this unique wall configuration permits the use of a relatively thin wall portion without a corresponding significant increase in stack height of the resultant nestable cup. Thus, a significant savings of plastic material is achieved without increasing the cube volume and stack height of the resultant nested containers and while maintaining an acceptable wall strength.

The instant invention also finds great utility as the size of the container is increased. In larger containers, a plurality of overlapping outwardly offset thin wall portions are utilized to form two or more annular thickened wall portions along the length of the sidewall. As stated previously, the sidewall configuration afforded by the instant invention provides acceptable wall strength while achieving a material cost savings due to the use of a lower density plastic material while simultaneously avoiding increases in stack height and cube volume of the containers.

In the standard containers of the prior art, any attempts to form a container by use of a lower density of plastic material has resulted in a corresponding increase in wall thickness in order to maintain acceptable wall strength. This has also resulted in a concomitant increase in stack height and volume size of the resultant nested containers.

Another feature of this invention is that when the lower thin wall portion overlaps with the outwardly offset thin wall portion immediately thereabove, there is formed an outwardly extending annular gripping step or ledge portion in the outer surface of the sidewall of the container. The outwardly extending step or ledge portion delineates the lowermost part of the annular thickened portion of the sidewall and provides ease of handling of the container. The ease of handling is brought about by the fact that some of the fingers of the hand engage the aforesaid step or outwardly extending ledge thereby enabling the user to more easily grasp the container without the necessity of exerting excessive force against the sidewall in order to hold the container. In the straight wall containers of the prior art, the user must exert greater gripping force against the side of the container in order to avoid slippage of the filled container downward through the gripping fingers.

It should also be noted that the annular thickened wall portion of the instant invention provides additional insulation protection for the fingers of the user. In the cup or container devices of the prior art, it has been necessary to maintain sufficiently thick walls to insure adequate protective insulation for the hands of the users when the container is filled with hot and/or cold liquids. This sometimes requires the use of more plastic material and/or higher density plastic materials with concomitant increases in cost.

In some devices of the prior known art, an annular band of supplemental insulating material is provided on the external surface of the container so as to provide protection for the hand of the user. However, such external protuberances have not only added to the material costs of the container, but have interfered with the nesting capabilities of the resultant containers.

Nowhere in the known prior art is there shown a step-wall nestable cup such as the claimed structure of applicant which has outwardly off-set thin wall sidewall portions which overlap to define an annular intermediate thickened wall portion which strengthens the cup while permitting the use of relatively thinner wall portions thereabove and therebelow.

Further, nowhere in the prior art is there shown a modified version of such a step-wall nestable cup wherein a plurality of outwardly off-set thin wall sidewall portions respectively overlap to define at least two or more annular thickened sidewall portions with thin wall portions therebetween.

It is therefore an object of this invention to provide a step-wall nestable cup having outwardly offset thin wall sidewall portions which overlap to define an annular intermediate thickened wall portion which strengthens the cup while permitting the use of relatively thinner wall portions thereabove and therebelow.

Another object of this invention is to provide a modified step wall nestable cup provided with multiple outwardly offset thin sidewall portions which respectively overlap to provide a plurality of spaced-apart annular thickened wall portions with thin wall portions therebetween.

Yet another object of this invention is to provide a step-wall nestable cup having off-set thin sidewall portions which overlap to define at least one annular thickened wall portion which strengthens the sidewall portion of the cup so as to permit the use of a lower density plastic material and lower total cup weight without increasing the stack height or volume size of the resultant cup or container.

A still further object of this invention is to provide a step-wall nestable cup having a sidewall portion in which at least one outwardly extending annular step or ledge portion is defined in the outer surface thereof so as to provide a gripping surface for the fingers or hand of the user.

Other objects and advantages found in the construction of the invention will be apparent from a consideration of the following specification in connection with the appended claims and the accompanying drawings.

IN THE DRAWINGS

GENERAL DESCRIPTION

Figure 1:
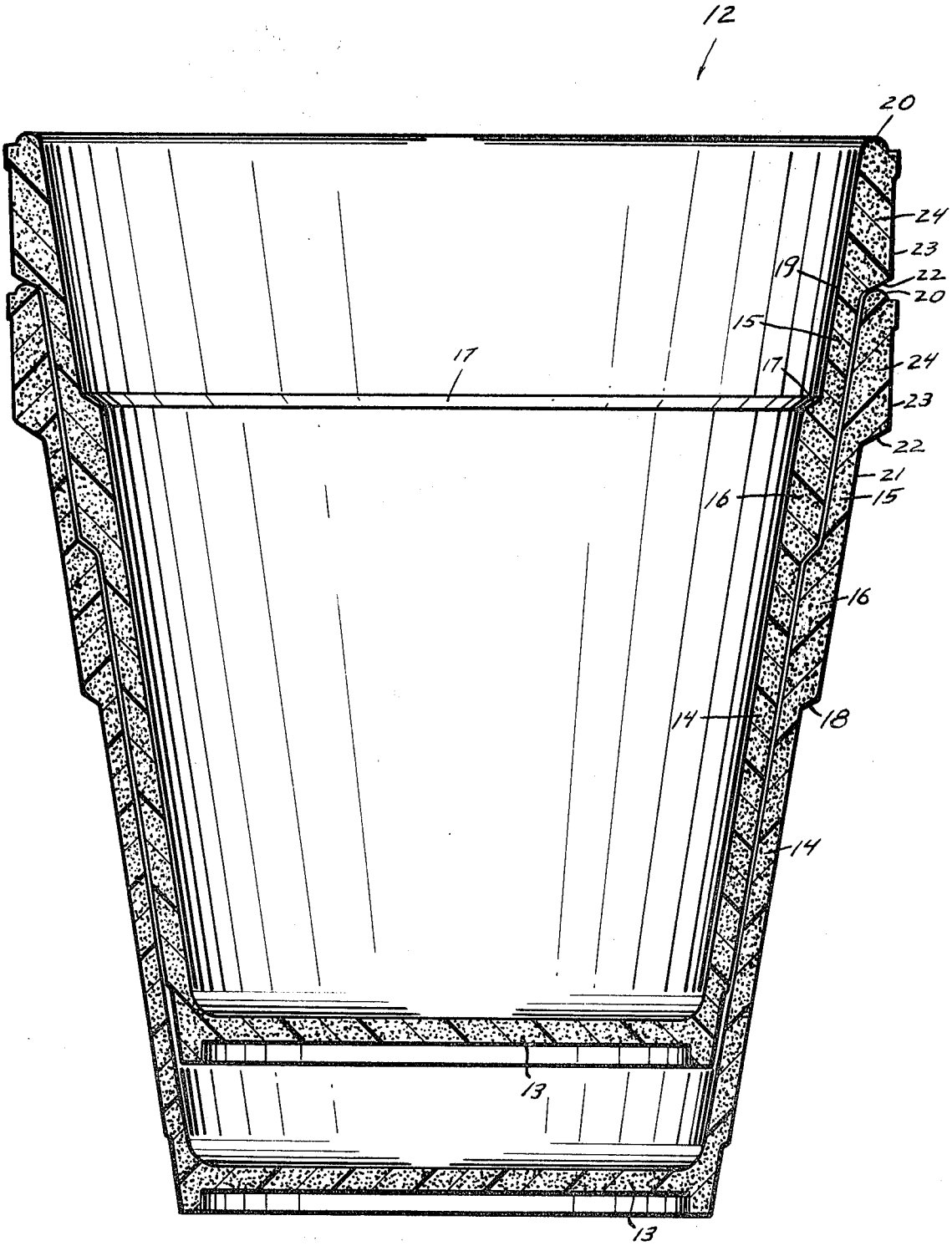
FIG. 1 is a schematic cross-sectional view showing a pair of step-wall nestable cups in nesting relationship.

In general, a step-wall nestable cup 12 is provided which is fabricated from expandable or foamable plastic resins such as polystyrene by cup forming techniques which are well known in the art. As shown generally in the drawings and specifically in FIGS. 2 through 5, the step wall nestable cup 12 comprises a circular base wall portion 13. A first outwardly inclined lower annular thin wall portion 14 is provided which integrally merges with and extends upwardly from the outer peripheral edge of the base wall portion 13. The first annular thin wall portion 14 overlaps with a second outwardly offset inclined upwardly extending annular thin wall portion 15 so as to define an intermediate annular thickened wall portion 16 therebetween. The annular thickened wall portion 16 is shown generally in the drawings and more specifically in FIG. 14

Figure 2:
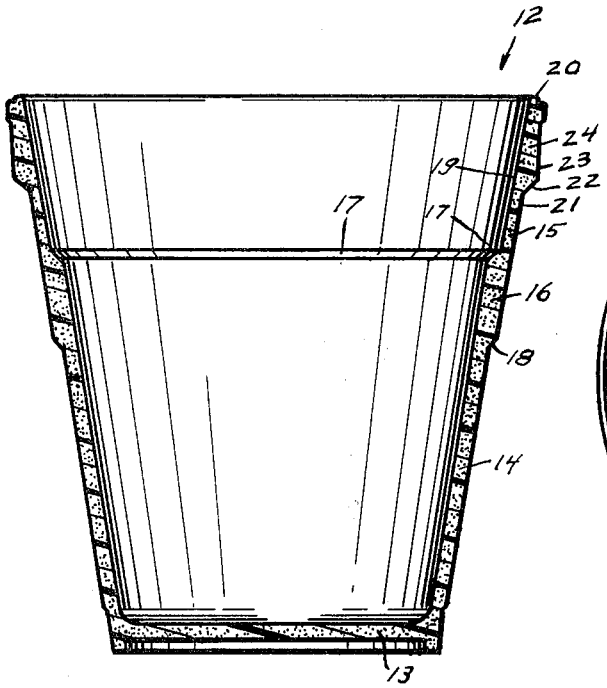
FIG. 2 is a schematic cross-sectional view of the step-wall nestable cup showing the offset thin sidewall portions which overlap to define an annular thickened portion therebetween.
Figure 4:
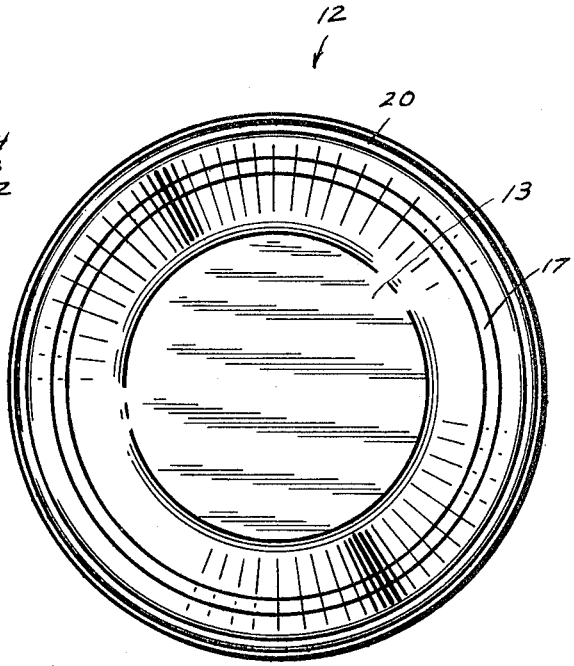
FIG. 4 is a top view of the step-wall nestable cup shown in FIG. 2.
Figure 3:
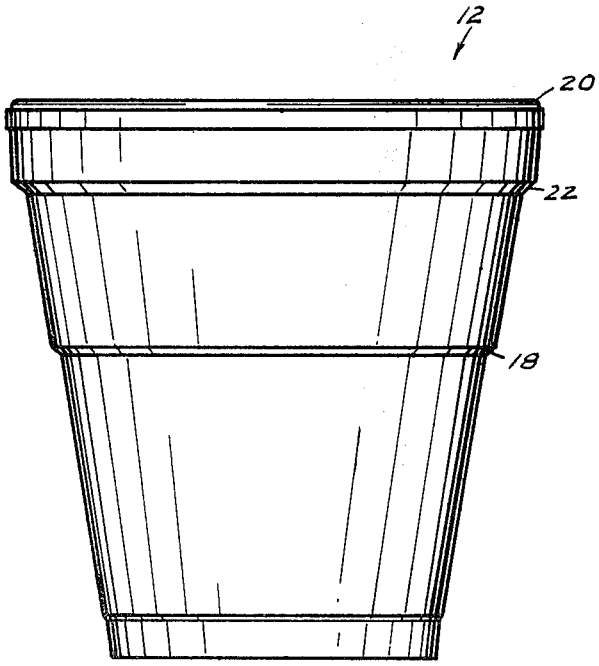
FIG. 3 is a side elevational view of the step-wall nestable cup shown in FIG. 2 and which shows the annular outwardly extending ledge or step portion which defines the lower edge of the annular thickened portion.
Figure 5:
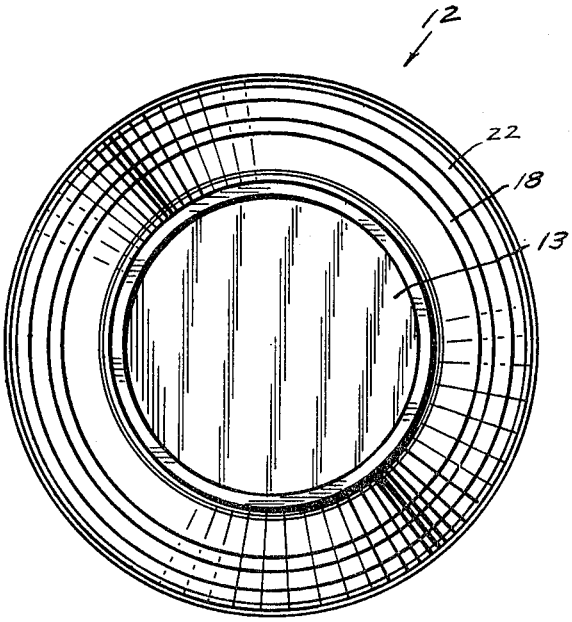
FIG. 5 is a bottom view of the step-wall nestable cup shown in FIG. 2.
Figure 14:
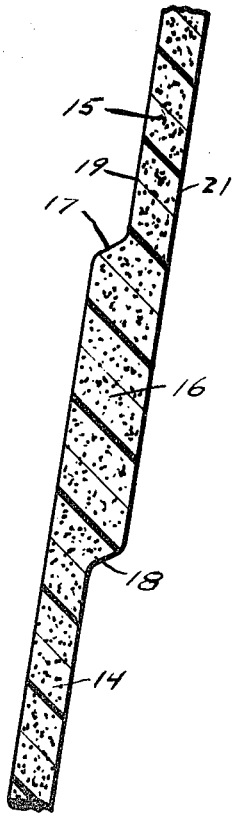
FIG. 14 is an enlarged partial schematic cross-sectional view showing the thin wall offset sidewall portions which overlap to define an annular thickened portion therebetween.

As shown in FIGS. 2 and 14, the thin wall portions 14 and 15 overlap to form an annular thickened sidewall portion 16 therebetween whose upper and lower limits of the annular thickened wall portion are defined by the inner outwardly extending step member 17 and the lower outer outerwardly extending step member 18 positioned therebelow. This unique configuration which involves thin wall sidewall portions 14 and 15 that overlap to form an annular thickened sidewall portion 16 provides a strengthened sidewall configuration which permits the use of a lower density plastic material and hence total lower weight of cup without a concomitant increase in overall wall thickness, stack height and volume size of the resultant nested cups or containers.

Figure 11:
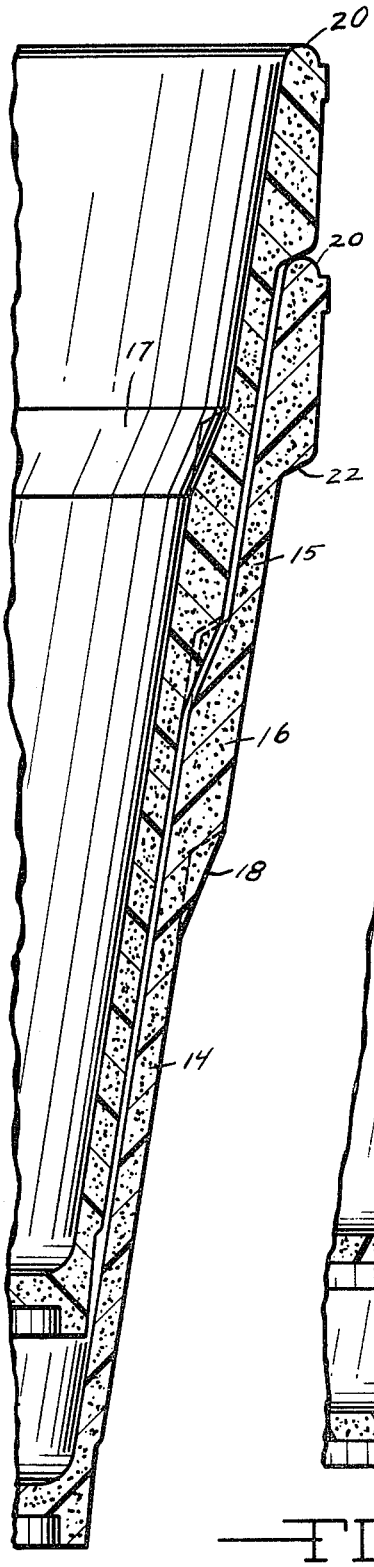
FIG. 11 is a schematic cross-sectional view of modified step-wall nestable cups in nesting relationship which have a modified configuration of the annular thickened portion of the sidewall.

More specifically, the upper portion of the first annular thin wall portion 14 terminates at the inner inclined step member 17 which merges into the inner surface 19 of the second annular thin wall portion 15. The lower portion of the second outwardly off-set thin wall portion 15 terminates at the lower outer step or ledge member 18 which merges into the outer surface of the first thin wall portion 14 as shown specifically in FIG. 14. The angle of inclination of the inner step member 17 can be varied as desired within a broad range from the horizontal upwardly to an angle which more gradually merges with the inner surface 19 of the second annular thin wall portion 15 thereabove. The angle of inclination of the lower outer step or ledge member 18 can also be varied as desired as long as it does not interfere with the surface of a cup nested therewith. This modification is shown in FIG. 11. Although the outer step member 18 is shown as being parallel to the inner step member 17 of a cup nested therewith, they do not have to be parallel as long as they do not interfere with each other in the nesting relationship. The phantom lines of FIG. 11 illustrates the standard step configuration in the preferred embodiments of FIGS. 2, 6 and 14.

As shown in FIGS. 1–5, the inner surface 19 of the second annular thin wall portion 15 extends upwardly to merge with the upper peripheral edge 20 of the step-wall nestable cup 12.

The upper portion of the outer surface 21 of the second offset thin wall portion 15 extends upwardly to merge with an annular outwardly extending stack step portion 22. The outer annular stack step 22 extends outwardly to merge with the outer surface 23 of the upper annular rim or lip flange 24 provided around the upper portion of the cup 12. The outer surface 23 of the lip flange portion 24 extends upwardly to merge with the upper peripheral edge 20 of the cup 12.

It is within the scope of the invention that the configuration of the nestable cup does not have an annular lip flange 24 or includes a lip flange of another configuration. For instance, the upper thin wall 15 can be extended to terminate at the rim edge 20 without having any annular lip provided thereon.

Figure 6:
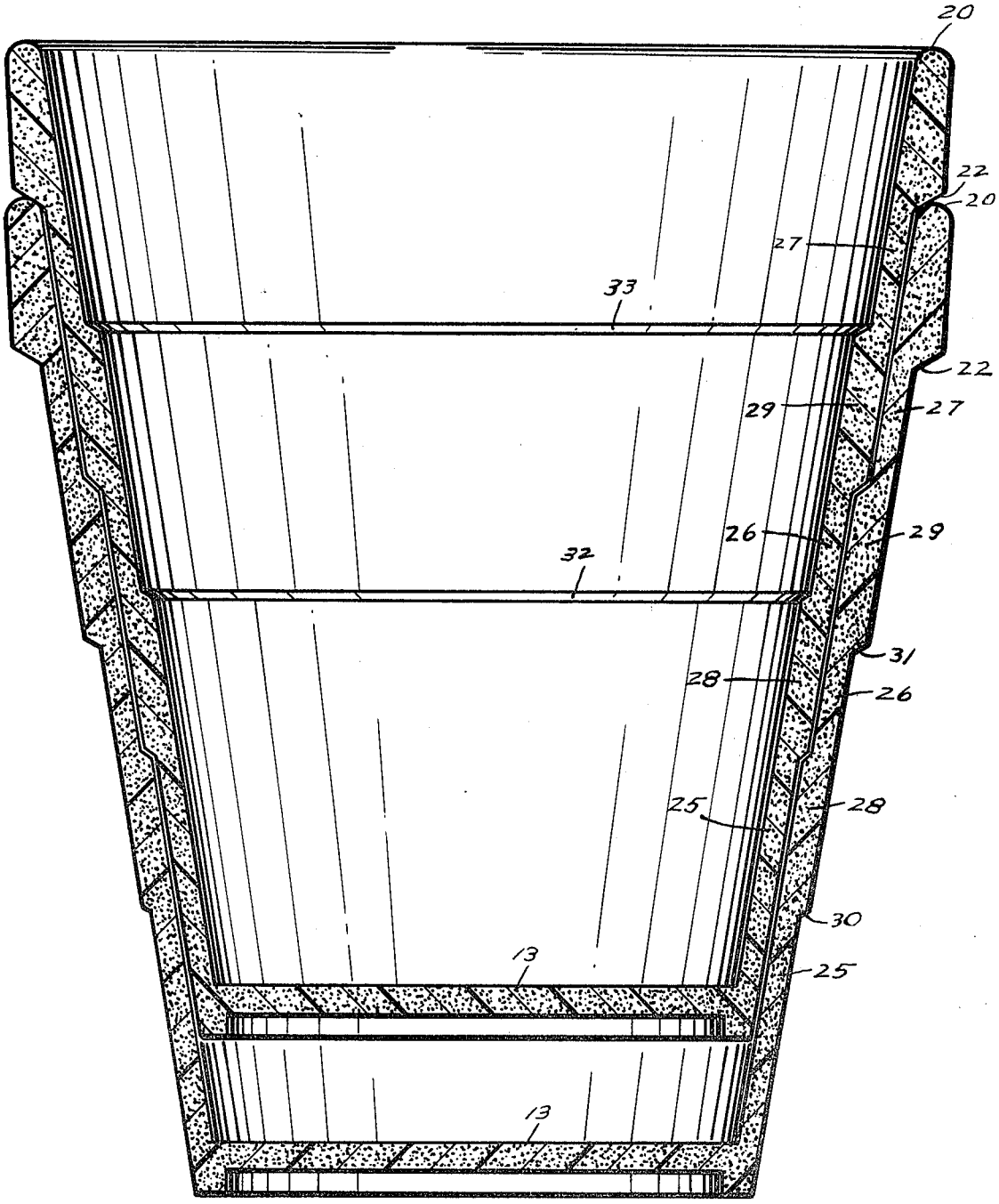
FIG. 6 is a schematic cross-sectional view of another embodiment of the step-wall nestable cups in nesting relationship.
Figure 7:
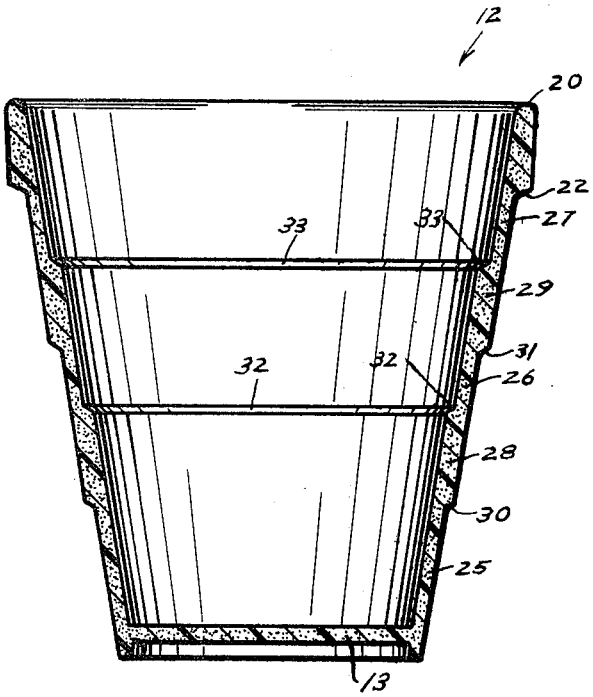
FIG. 7 is a schematic cross-sectional view of the embodiment of the step-wall nestable cup shown in FIG. 6 and further illustrating two annular spaced apart elongate thickened portions in the central portion of the sidewall thereof.
Figure 9:
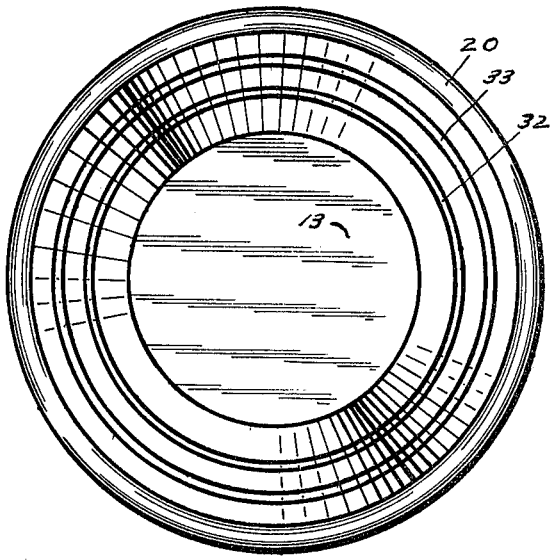
FIG. 9 is a top view of the step-wall nestable cup shown in FIG. 7.
Figure 8:
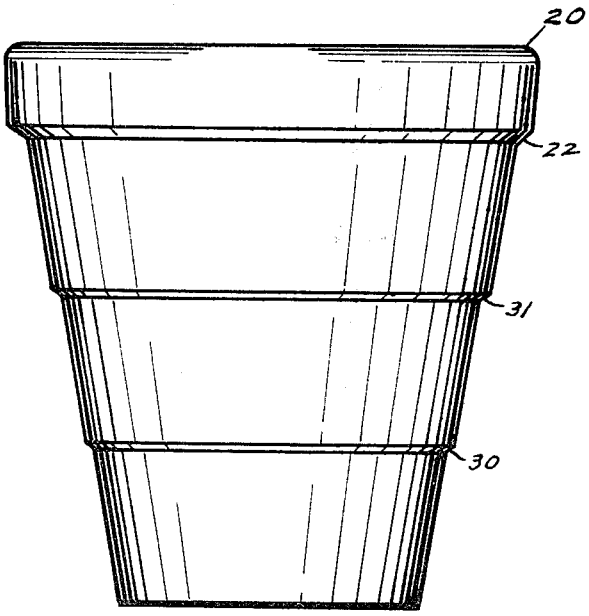
FIG. 8 is a side elevational view of the step-wall nestable cup shown in FIG. 7.
Figure 10:
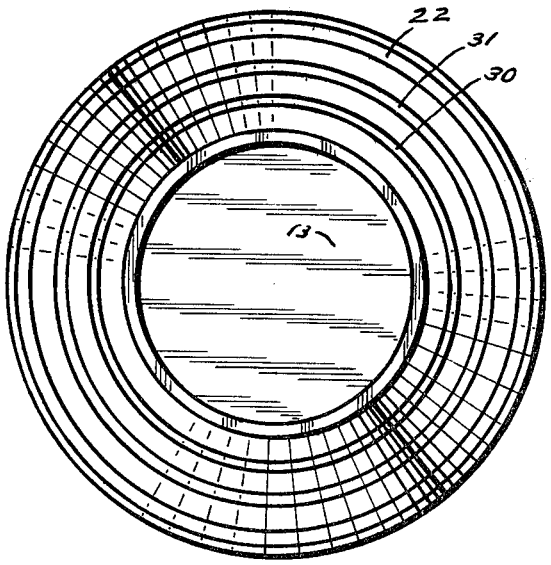
FIG. 10 is a bottom view of the step-wall nestable cup shown in FIG. 7.

In the embodiment of the cup as shown in FIGS. 1 and 6, the cup 12 is easily nestable with another cup. A plurality of cups 12 are thus vertically stackable within each other. In its nested relationship, the outer annular stack step 22 of the container 12 rests upon and is supported by the upper peripheral edge 20 of the container positioned therebelow. The stacked or nested containers 12 do not touch or otherwise engage the next adjacent cup in which they are respectively nested except for the aforementioned supporting contact between the annular stack step 22 and the upper peripheral edge 20 of the cup immediately therebelow.

Due to the resilient nature of the material from which the cups are formed, it is possible that the various surfaces of the nested cups might inadvertently come into contact with each other. However, this invention does not contemplate any slidable and/or lockable sealed contact between the surfaces of the nested cups. Thus, in view of the fact that the only contact between the nested cups is between the stack step 22 and the upper peripheral edge 20, the nesting engagement and disengagement of the cups is easily achieved without any problems due to undesired vacuum or suction conditions brought about as a result of the nesting process.

Figure 12:
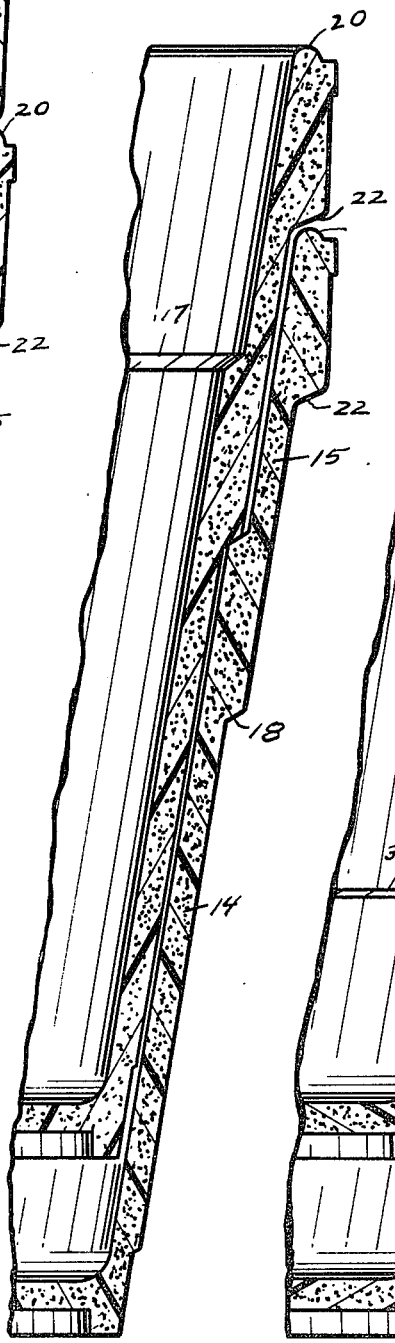
FIG. 12 is a schematic cross-sectional view of nested cups showing a modified cup configuration illustrating a different nesting relationship.
Figure 13:
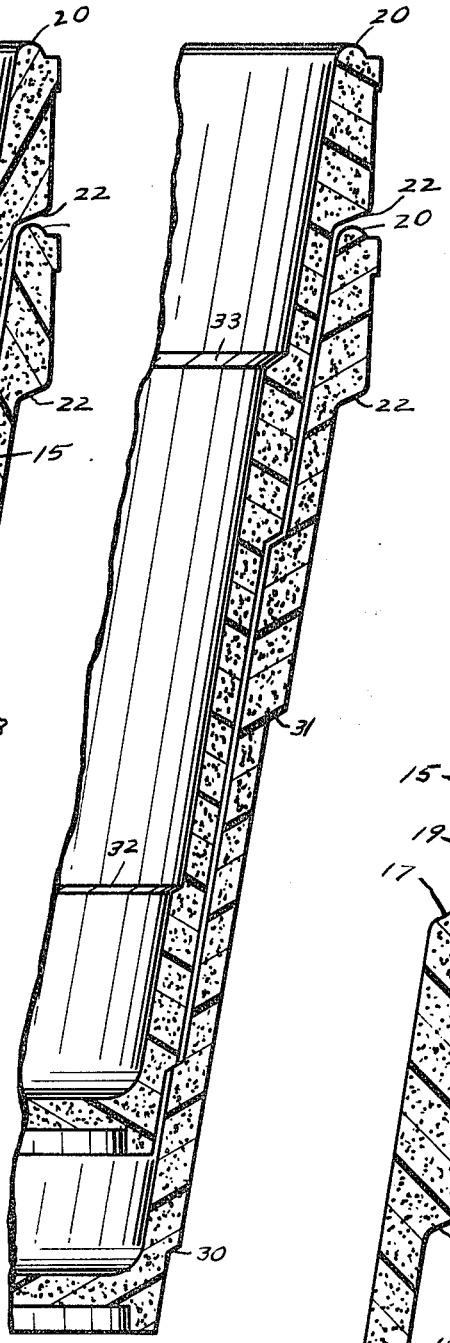
FIG. 13 is a schematic cross-sectional view of nested cups showing a modified cup configuration illustrating another nesting relationship.

Further, it is within the scope of the invention that the nesting contact between the nested cups not be limited to the contact between the stack step 22 and the edge 20. Nesting support contact could occur at other contact points as shown in FIGS. 12 and 13 or at any other desired points.

As shown in FIGS. 2 and 14, the thin wall portions 14 and 15 overlappingly merge to form an annular thickened sidewall portion 16 therebetween whose upper and lower limits of the annular thickened wall portion 16 are defined by the inner outwardly extending step member 17 and the lower outer outwardly extending step member 18 positioned therebelow. This unique configuration which involves thin wall sidewall portions that overlappingly merge to form an annular thickened sidewall portion provides a strengthened sidewall configuration which permits the use of a lower density plastic material and hence total lower weight of cup without a concomitant increase in overall wall thickness, stack height and volume size of the resultant nestable cups or containers.

It is also considered to be within the scope of the invention to provide larger step-wall nestable cups or larger containers which are provided with multiple outwardly off-set thin wall sidewall portions which overlappingly merge to define a plurality of spaced-apart annular thickened wall portions which strengthen the sidewall of the container while permitting the use of lower density plastic material to fabricate the container without a concomitant increase in overall wall thickness, stack height and cube volume size of the resultant package of nestable cups and/or containers.

Thus, in the embodiment of the invention as shown in FIG. 6 through 10, three outwardly offset thin wall portions, 25, 26 and 27, respectively, overlappingly merge to define a pair of annular spaced thickened wall portions 28 and 29 in the sidewall of each of the nestable cups. As shown, the first lower thin wall portion 25 extends upwardly from the base portion to overlappingly merge at the upper portion thereof with the lower portion of the second outwardly off-set intermediate thin-wall portion 26 so as to define a first lower annular thickened portion 28 in the sidewall. The second intermediate thin wall portion 26 extends upwardly to overlappingly merge with at the upper end thereof with the lower portion of the third outwardly offset thin wall portion 27 so as to define the second upper annular thickened portion 29 which is spaced apart from and above the lower annular thickened portion 28.

As further shown in FIGS. 6 through 10, the lower portions of the annular thickened portions 28 and 29 define outer outwardly gripping steps 30 and 31, respectively, in the outer surface of the sidewall of the cup or container. Further, the upper portions of the annular thickened portions 28 and 29 define inner steps 32 and 33, respectively, in the inner surface of the sidewall of the cup or container. In the embodiments of the invention having more than two annular thickened portions, additional outer gripping steps are accordingly provided in the outer surface of the sidewall of the cup or container.

As stated previously and as shown in FIGS. 1 and 6, the nesting contact between the nested cups of the preferred embodiments occurs between the respective stack step 22 and the upper peripheral edge 20 of the next adjacent cup stacked therewith. However, as shown in FIGS. 12 and 13, such stacking or nesting contact can selectively occur between selected of the inner steps 17, 32 or 33 and outer gripping steps 18, 30 and 31, respectively, as desired.

As the size of the cups or containers is increased, it is considered to be within the scope of the invention to utilize additional outwardly offset thin wall portions which respectively overlap to provide additional annular thickened sidewall portions to provide additional strength to the overall sidewall of the larger container without corresponding increase in wall size, stack height and volume size of the larger container.

As in the case of the cup shown in FIGS. 1 through 5, the larger containers having two or more spaced-apart annular thickened portions provided in the sidewalls thereof, are also provided with an outer annular stack step 22 which engages the upper rim 20 of the cup therebelow. Here again, as the case of the cups having a single annular thickened portion, the larger cups or containers are similarly nestable within each other. Further, the modifications involving the various nesting configurations and angles of inclination of the steps or ledges as previously discussed with respect to the cup shown in FIGS. 1 through 5, would be applicable to the larger cups having multiple spaced-apart, annular thickened portions.

Although the present embodiment of the invention has been described in terms of expandable polystyrene foam plastic cups and containers, it is considered to be within the scope of the invention that it be utilized in connection with cups and containers having a molded solid plastic configuration. Further, the unique construction embodied in the present invention could be utilized in the fabrication of plastic pails, plastic garbage cans and other large utility containers. The advantages would remain the same, i.e., reduced wall thickness while maintaining or increasing wall strength and reduced average weight with resultant economies due to savings arising out of the use of less plastic material.

It should further be noted that while the present embodiment of the invention has been described in terms of a nestable cup or container, it is considered to be within the scope of the invention that it be utilized in connection with cups and containers that are not necessarily of the nestable type and/or even of a conical or circular configuration. Thus, a square base portion could be utilized with sidewalls extending upwardly from the peripheral edges therefrom.

It should be noted that it is within the scope of the invention that the thickness of the annular thickened portion 16 formed by the thin wall portions 14 and 15 which overlappingly merge as shown in FIG. 14 and generally in the drawings can be varied as desired. For instance, the thickness of the annular thickened portion 16 can selectively be (1) less than the sum of the thicknesses of the thin wall portions 14 and 15, (2) equal to the sum of the thicknesses of the thin wall portions 14 and 15, or (3) larger than the sum of the thin wall portions 14 and 15. The thickness of the annular thickened portion 16 would of course vary depending on the distance that the thin wall portion 15 was outwardly off-set from the lower thin wall portion 14. It is thus seen that greater flexibility of design and manufacture is possible by varying the thickness of the annular thickened portion as desired.

Further, it should be noted that in the modifications of the invention having two or more annular thickened portions, the respective annular thickened portions can be of the same or different thicknesses. Thus, in the embodiment shown in FIG. 7, the thickness of the lower annular thickened portion 28 is less than the thickness of the upper annular thickened portion 29. Here again there is flexibility of design in determining the relative thickness of each annular thickened portion.

It should also be noted that it is also within the scope of the invention that in the modifications having two or more annular thickened portions, it is contemplated that the annular thickened portions can vertically overlap as well as being vertically spaced apart as shown in the drawings.

Although it has heretofore been emphasized that the use of this invention results in material savings in the fabrication of cups and containers, it should be noted that the use of this invention can also result in shipping cost savings. For instance, the provision of annular thickened wall portions brought about by overlapping thin wall portions permits the use of thinner walls with resultant reduced stack height. The reduced stack height results in a smaller cube volume of the resultant stacked or nested cups and, hence, shipping cost savings are realized because less overall volume is required to ship the nested cups. Thus, the invention results in savings due to use of less material and/or the requirement of less shipping space or any possible combinations thereof.

It should also be noted that the outer surfaces of the cups or containers can be scored or otherwise roughened so as to further increase the gripability of the cups already afforded by the steps or ledges provided on the outer surface of the cups.

Thus, a step-wall container is provided which comprises a base portion having a sidewall extending upwardly therefrom so as to define a container. The sidewall includes a first lower thin wall portion and an outwardly off-set second upper thin wall portion. The first lower thin wall portion extends upwardly from the base portion to overlap at the upper portion thereof with the lower portion of the second outwardly off-set upper thin wall portion so as to define an annular thickened portion in the sidewall of the container. In another embodiment of the invention, a step-wall container is provided which comprises a base portion having a sidewall extending upwardly therefrom so as to define a container. The sidewall includes a first lower thin wall portion, a second outwardly off-set intermediate thin wall portion and a third outwardly off-set upper thin wall portion. The first lower thin wall portion extends upwardly from the base portion to overlap at the upper portion thereof with the lower portion of the second outwardly off-set intermediate thin wall portion so as to define a first lower annular thickened portion in the sidewall of the container. The second intermediate thin wall portion extends upwardly to overlap at the upper portion thereof with the lower portion of the third outwardly off-set upper thin wall portion so as to define a second upper annular thickened portion in the sidewall.

In still another embodiment of the invention, a step-wall container is provided which comprises a base portion having a sidewall extending upwardly therefrom so as to define a container. The sidewall includes a plurality of thin wall portions. Each of said thin wall portions is outwardly off-set in relation to selected of the thin wall portions positioned therebelow. Selected of the thin wall portions are configured to overlap one with the other so as to define a plurality of annular thickened portions in the sidewall of the container. Further, a step-wall nestable cup is provided which comprises a base portion having an outwardly inclined sidewall extending upwardly therefrom to terminate at an upper peripheral edge. The sidewall includes a first lower thin wall portion and second upper outwardly off-set thin wall portion. The first lower thin wall portion extends upwardly from the base portion to overlap at the upper portion thereof with the lower portion of the second outwardly offset upper thin wall portion so as to define an annular thickened portion in the sidewall.

In the foregoing step-wall nestable cup configuration, an outwardly extending lip flange is provided along the upper peripheral edge. The lip flange defines an outer outwardly extending stack step therebelow. Another embodiment of the step-wall nestable cup is provided which comprises a base portion having an outwardly inclined sidewall extending upwardly therefrom to terminate at an upper peripheral edge. The sidewall includes a first lower thin wall portion, a second outwardly off-set intermediate thin wall portion and a third outwardly offset upper thin wall portion. The first lower thin wall portion extends upwardly from the base portion to overlap at the upper portion thereof with the lower portion of the second outwardly off-set intermediate thin wall portion so as to define a first lower annular thickened portion in the sidewall. The intermediate thin wall portion extends upwardly to overlap at the upper portion thereof with the lower portion of the third outwardly off-set upper thin wall portion so as to define a second upper annular thickened portion in the sidewall.

In the foregoing step-wall nestable cup configuration, an outwardly extending lip flange is provided along the upper peripheral edge. The lip flange defines an outer outwardly extending stack step therebelow.

Yet another embodiment of the step-wall nestable cup is provided which comprises a base portion having an outwardly inclined sidewall extending upwardly therefrom to terminate at an upper peripheral edge. The sidewall includes a plurality of thin wall portions. Each of the thin wall portions are outwardly off-set in relation to selected of the thinwall portions positioned therebelow. Selected of the thin wall portions are configured to overlap one with the other so as to define a plurality of annular thickened portions in the sidewall.

In the foregoing step-wall nestable cup configuration an outwardly extending lip flange is provided along the upper peripheral edge. The lip flange defines an outer outwardly extending stack step therebelow.

Further, in each of the foregoing embodiments of the invention, the lower portion of the annular thickened portion defines an outer gripping step in the outer surface of the sidewall of the cup or container.

It is thus seen that a highly utilitarian step-wall nestable cup or container is provided which results in significant material and/or shipping cost savings while maintaining wall strength and without increasing the cube volume and stack height of the resultant nested containers.

In summary, as described herein and as shown generally in the drawings, a unique step-wall nestable cup is provided which comprises a base portion having an integrally formed sidewall extending upwardly therefrom to terminate at an upper peripheral edge so as to define a container. The sidewall includes a first lower inner wall surface tapering upwardly to an outwardly extending inner offset step and a second upper inner wall surface tapering upwardly from the inner offset step. The sidewall further includes a first lower outer wall surface tapering upwardly to an outwardly extending outer offset step and a second upper outer wall surface tapering upwardly from the outer offset step. The outer offset step is located below and spaced-apart from the inner offset step so as to define an annular thickened portion therebetween.

Another embodiment of the invention consists of a unique step-wall nestable cup which comprises a base portion having an integrally formed sidewall extending upwardly therefrom to terminate at an upper peripheral edge so as to define a container. The sidewall includes a first lower inner wall surface tapering upwardly to an outwardly extending first lower inner offset step and a second intermediate inner wall surface tapering upwardly from the first lower inner offset step to an outwardly extending second upper inner offset step and a third upper inner wall surface tapering upwardly from the second upper inner offset step. The sidewall further includes a first lower outer wall surface tapering upwardly to an outwardly extending first lower outer offset step and a second intermediate outer wall surface tapering upwardly from the first lower outer offset step to an outwardly extending second upper outer offset step and a third upper outer wall surface tapering upwardly from the second upper outer offset step. The first lower outer offset step being located below and spaced-apart from the first inner offset step so as to define a first lower annular thickened portion therebetween. The second upper outer offset step being located below and spaced-apart from the second upper inner offset step so as to define a second upper annular thickened portion therebetween.

Each of the further embodiments of the invention can also be selectively provided with an outwardly extending annular lip flange along the upper peripheral edge thereof so as to define an outer outwardly extending annulat stack step therebelow.

Various other modifications of the invention may be made without departing from the principle thereof. Each of the modifications is to be considered as included in the hereinafter appended claims, unless these claims by their language expressly provide otherwise.

I claim:

1. A step-wall nestable cup comprising:

a base portion having an integrally formed sidewall extending upwardly therefrom to terminate at an upper peripheral edge so as to define a container, said sidewall including a first lower inner wall surface tapering upwardly to an outwardly extending inner offset step and a second upper inner wall surface tapering upwardly from said inner offset step, said sidewall including a first lower outer wall surface tapering upwardly to an outwardly extending outer offset step and a second upper outer wall surface tapering upwardly from said outer offset step, said outer offset step being located below and spaced-apart from said inner offset step so as to define an annular thickened portion therebetween.

2. In the step-wall container of claim 1 wherein an outwardly extending annular lip flange is provided along said upper peripheral edge, said lip flange defining an outer outwardly extending annular stack step therebelow.

3. In the step-wall container of claim 1 wherein the lower portion of said annular thickened portion defines an outer gripping step in the outer surface of said sidewall.

4. A step-wall nestable cup comprising:

a base portion having an integrally formed sidewall extending upwardly therefrom to terminate at an upper peripheral edge so as to define a container, said sidewall including a first lower inner wall surface tapering upwardly to an outwardly extending first lower inner offset step and a second intermediate inner wall surface tapering upwardly from said first lower inner offset step to an outwardly extending second upper inner offset step and a third upper inner wall surface tapering upwardly from said second upper inner offset step, said sidewall including a first lower outer wall surface tapering upwardly to an outwardly extending first lower outer offset step and a second intermediate outer wall surface tapering upwardly from said first lower outer offset step to an outwardly extending second upper outer offset step and a third upper outer wall surface tapering upwardly from said second upper offset step, said first lower outer offset step being located below and spaced-apart from said first inner offset step so as to define a first lower annular thickened portion therebetween, said second upper outer offset step being located below and spaced-apart from said second upper inner offset step so as to define a second upper annular thickened portion therebetween.

5. In the step-wall container of claim 4 wherein an outwardly extending annular lip flange is provided along said upper peripheral edge, said lip flange defining an outer outwardly extending annular stack step therebelow.

6. In the step-wall container of claim 4 wherein the lower portions of said first lower annular thickened portion and said second upper annular thickened portion define outer gripping steps in the outer surface of said sidewall.

* * * * *